US010174653B2

(12) United States Patent
Petley et al.

(10) Patent No.: US 10,174,653 B2
(45) Date of Patent: Jan. 8, 2019

(54) VEHICLE NOISE SUPPRESSION METHOD

(71) Applicant: JAGUAR LAND ROVER LIMITED, Warwickshire (GB)

(72) Inventors: Dean Petley, Coventry (GB); Simon Fletcher, Coventry (GB)

(73) Assignee: JAGUAR LAND ROVER LIMITED, Whitley, Coventry (GB)

( * ) Notice: Subject to any disclaimer, the term of this patent is extended or adjusted under 35 U.S.C. 154(b) by 0 days.

(21) Appl. No.: 15/504,895

(22) PCT Filed: Aug. 19, 2015

(86) PCT No.: PCT/EP2015/069030

§ 371 (c)(1),
(2) Date: Feb. 17, 2017

(87) PCT Pub. No.: WO2016/026890

PCT Pub. Date: Feb. 25, 2016

(65) Prior Publication Data

US 2017/0234180 A1 Aug. 17, 2017

(30) Foreign Application Priority Data

Aug. 20, 2014 (GB) ..... 1414761.5

(51) Int. Cl.

| | |
|---|---|
| ***G10K 11/16*** | (2006.01) |
| ***H04R 3/00*** | (2006.01) |
| ***F01N 1/06*** | (2006.01) |
| ***F01N 1/16*** | (2006.01) |
| ***G10K 11/178*** | (2006.01) |
| ***G10K 15/02*** | (2006.01) |

(Continued)

(52) U.S. Cl.

CPC ..... *F01N 1/065* (2013.01); *F01N 1/16* (2013.01); *G10K 11/178* (2013.01); *G10K 15/02* (2013.01); *H04R 3/12* (2013.01); *H04R 29/001* (2013.01); *G10K 2210/1282* (2013.01); *G10K 2210/12822* (2013.01); *H04R 2499/13* (2013.01)

(58) Field of Classification Search

CPC ..... F01N 1/065; F01N 1/16; G10K 11/16; G10K 11/178; G10K 15/62; G10K 2210/1282; G10K 2210/12822; H04R 3/00; H04R 3/12; H04R 29/001; H04R 2499/13

See application file for complete search history.

(56) References Cited

U.S. PATENT DOCUMENTS

| | | | | |
|---|---|---|---|---|
| 5,097,923 A | | 3/1992 | Ziegler et al. | |
| 5,321,759 A | * | 6/1994 | Yuan | G10K 11/1786 381/71.12 |
| 5,336,856 A | | 8/1994 | Krider et al. | |

(Continued)

FOREIGN PATENT DOCUMENTS

| | | |
|---|---|---|
| EP | 2 110 523 A1 | 10/2009 |
| WO | 94/22403 | 10/1994 |
| WO | 2011/005872 A2 | 1/2011 |

OTHER PUBLICATIONS

Combined Search and Examination Report under Sections 17 and 18(3) for Application No. GB 1414761.5 dated Feb. 3, 2015.

(Continued)

*Primary Examiner* — Thang V Tran

(57) ABSTRACT

Aspects of the present invention relate to noise modification systems of motor vehicles, and controllers and methods of use thereof.

34 Claims, 3 Drawing Sheets

(51) Int. Cl.
*H04R 3/12* (2006.01)
*H04R 29/00* (2006.01)

(56) References Cited

U.S. PATENT DOCUMENTS 5,359,662 A 10/1994 Yuan et al.
5,386,472 A * 1/1995 Pfaff ..... F01N 1/065 381/71.12
5,600,106 A 2/1997 Langley
5,693,918 A 12/1997 Bremigan et al.
5,848,168 A * 12/1998 Shipps ..... G10K 11/178 381/71.5
5,850,458 A * 12/1998 Tomisawa ..... G10K 11/1786 381/71.4
8,045,723 B2 10/2011 Kobayashi et al.
2001/0021258 A1 9/2001 Nagel
2002/0039422 A1 4/2002 Daly
2004/0086135 A1 5/2004 Vaishya
2006/0074645 A1 4/2006 Tischer
2007/0261395 A1* 11/2007 Mahnken ..... F01N 1/165 60/297
2012/0076314 A1 3/2012 Reilly et al.
2012/0257763 A1 10/2012 Bowden et al.
2014/0321659 A1* 10/2014 Buganza ..... G10K 11/002 381/71.4
2015/0100221 A1* 4/2015 Routledge ..... F01N 1/165 701/111
2016/0123210 A1* 5/2016 Dmytrow ..... F01N 9/00 137/599.11
2016/0138508 A1* 5/2016 Sczomak ..... F02D 41/2422 701/2

OTHER PUBLICATIONS

International Search Report and Written Opinion of the International Searching Authority for International application No. PCT/EP2015/069030 dated Nov. 16, 2015.
Combined Search and Examination Report under Sections 17 and 18(3) for Application No. GB 1514704.4 dated Feb. 17, 2016.

* cited by examiner

Vehicle Driving Mode

| | | Hush | Normal | Sport | Track |
|---|---|---|---|---|---|
| | Rapid | Off | Enhance 1 | Enhance 2 | Enhance 2 |
| Throttle | Slow | Suppress | Off | Enhance 1 | Enhance 2 |
| Pedal | Static instant (upper part of pedal travel) | Suppress | Off | Off | Enhance 1 |
| Movement | Static instant (lower half of pedal travel) | Off | Off | Enhance 1 | Enhance 2 |
| | Static > 30 seconds | Suppress | Suppress | Off | Enhance 1 |
| | Static > 60 seconds | Suppress | Suppress | Suppress | Off |

Noise Modification System state in various Vehicle Driving Modes (dependent on Throttle Pedal Movement)

Figure 2

VEHICLE NOISE SUPPRESSION METHOD

TECHNICAL FIELD

The present invention relates to vehicles equipped with noise modification apparatus, and methods and a controller for controlling such apparatus.

BACKGROUND OF THE INVENTION

It is known to provide noise modification systems in motor vehicles. Such systems typically comprise one of two types—Active Noise systems, in which one or more speaker units are fitted to exhaust systems or elsewhere in a vehicle such as in the occupant cabin, and Active Exhaust systems, in which typically one or more bypass valves are provided within an exhaust system to physically alter the flow path of exhaust gasses through different parts of the exhaust system.

The speakers in Active Noise systems, in conjunction with various control means and methods, are used to provide noise waveforms, usually related to and/or derived from the 'natural' noise generated by the exhaust system. These noise waveforms are typically used to 'cancel out', minimise or suppress native exhaust notes, but may also be used to enhance them.

In Active Exhaust systems, operation of the bypass valves typically allows either a 'normal' exhaust note, or, when the exhaust gasses are bypassed either to a specially tuned exhaust section or such that the exhaust system becomes more akin to a 'straight through' system, a more 'sporty' (ie: louder and more aggressive, sometimes referred to as 'throatier') exhaust note.

In known systems, a vehicle is provided with various driving modes. Such modes may comprise, for example, 'Normal,' 'Sport,' and 'Dynamic' modes, but may also comprise further modes such as 'Track'. An Active Noise or Active Exhaust system may be arranged to enhance exhaust (and/or engine) noise in certain modes (such as 'sport' or 'dynamic' modes), but in other modes (ie 'Normal') they are arranged to be off, or in the case of Active Noise systems even to damp or cancel out or otherwise minimise the exhaust noise. It is an aim of the present invention to provide improvements upon the prior art.

SUMMARY OF THE INVENTION

Aspects of the present invention relate to a controller for controlling a noise modification system, methods of control of a noise modification system, a noise modification system, an exhaust system and a vehicle.

According to an aspect there is provided a controller arranged to control a noise modification system of a vehicle provided with an exhaust system, wherein the controller is adapted to receive a noise signal from a noise sensor providing a measurement of noise in the exhaust system, and adapted to select a noise modification action of the noise modification system in dependence upon determination of a driving style of a driver of the vehicle and in dependence upon said measurement of noise, and operable to transmit a control signal to cause one or more speakers to modify noise emitted by the exhaust system in dependence on said noise modification action. Modifying the sound emitted by the exhaust system provides for a more natural sound. The noise sensor and/or speakers may be acoustically connected so as to output sound into at least a portion of the exhaust system.

The controller may be operable to transmit the control signal to cause said one or more speakers to modify said measured noise in the exhaust system. The noise signal from the noise sensor may provide a measurement of noise in the exhaust system modified by said noise modification action. Closed loop noise modification advantageously offers improved accuracy, bandwidth and flexibility over open loop noise modification.

According to an aspect there is provided a controller arranged to control a noise modification system of a vehicle provided with an exhaust system, the controller arranged to select a noise modification action of the noise modification system in dependence upon a selected driving mode of the vehicle, wherein the controller is further arranged to select an alternative noise modification action of the noise modification system in dependence upon a driving style of a driver of the vehicle, and operable to transmit a control signal to cause one or more speakers to modify noise emitted by the exhaust system in dependence on said noise modification action. The alternative noise modification action may be selected whilst the driving mode of the vehicle remains unchanged.

According to an aspect there is provided a method of control of a noise modification system adapted for use with an exhaust system of a vehicle, comprising:

Determining a driving style of a driver of said vehicle;

Selecting a noise modification action of the noise modification system in dependence on the said driving style; and Causing, at least in part, modification of noise emitted by the exhaust system in dependence on said noise modification action.

According to an aspect there is provided a method of control of a noise modification system adapted for use with an exhaust system of a vehicle, comprising:

Selecting a vehicle Driving Mode;

Determining a driving style of a driver of the vehicle;

Selecting a noise modification action of the noise modification system in dependence on the said driving style; and Causing, at least in part, modification of noise emitted by the exhaust system in dependence on said noise modification action.

According to an aspect there is provided a method of control of a noise modification system adapted for use with an exhaust system of a vehicle, comprising:

Selecting a vehicle Driving Mode;

Selecting a noise modification action of the noise modification system associated with said Driving Mode;

Determining a driving style of a driver of the vehicle;

Changing the noise modification action of the noise modification system in dependence on the said driving style; and Causing, at least in part, modification of noise emitted by the exhaust system in dependence on said noise modification action.

In embodiments, the noise modification system may comprise an Active Noise system. In embodiments, the noise modification system may comprise an Active Exhaust system. In embodiments, the noise modification system may comprise an Active Noise system and an Active Exhaust system. It may be that there are a number of noise modification actions available—no action; noise suppression (where engine or exhaust noise in at least one tonal range is made quieter to some degree); noise cancelling (where engine or exhaust noise is in at least one tonal range reduced substantially to zero); or noise enhancement (where at least one aspect of engine/exhaust noise is increased—for example, made louder, or certain tonal ranges enhanced, enabled, or made louder). It may be that the noise management system is able to act such that an Active Noise system may suppress or cancel noise in some circumstances and an Active Exhaust system may be used to enhance noise in other circumstances; or that Active Noise and Active Exhaust systems may together enhance noise in certain circumstances. The skilled person will recognise that various combinations of noise modification activity may be provided by various arrangements of noise modification systems, and that all these may fall within the ambit of the present invention.

The advantage of this is that the exhaust system will emit a noise which is in keeping with the current way the vehicle is being driven. In the prior art, a vehicle mode (ie: 'normal' or 'dynamic') is selected and the noise modification system will be operating in a fashion associated purely with that vehicle mode. In the present invention, it is possible for the engine noise to be representative of the way the vehicle is being driven, either irrespective of the vehicle mode that is selected, or in conjunction with it.

Thus, for example, in the prior art, a 'sport' mode may be selected and the engine/exhaust note is correspondingly continuously loud and aggressive as a result of noise enhancement from the noise modification system, whilst that mode is selected. However, this enhancement will still then be active if the vehicle is simply being driven at a steady 30 mph, for example, through a residential area. In the present invention, in contrasting example, the noise modification system may perform different functions independent, or at least partly independent, of the vehicle mode which is selected.

So, for example, if 'sport' mode is selected, the noise modification system would default to an enhanced, for example throaty exhaust note, but if it is then noted by for example a controller of the vehicle that the vehicle is simply moving at a steady 30 mph for more than a minute or two (and thus, perhaps, is moving through a residential area), the noise modification system may become inactive or may even actively change its action so as to suppress engine/exhaust noise. Should the driver then accelerate sharply, such as may occur for example on transition from a residential 30 mph zone to an open road 60 mph zone, the noise modification system may then switch back to an enhancement mode.

Under the same road circumstances, 'normal' mode of the vehicle may be selected, in which the noise modification system is either off or operating to suppress exhaust/engine noise. In such case, if it is noted that the vehicle is behaving as if in a 30 mph residential zone, the noise modification system remains off or acting to suppress. If the vehicle then accelerates at a comparatively low rate of acceleration, the noise modification system continues to remain 'off' or acts to suppress. However, if the vehicle is then accelerated at a comparatively high rate of acceleration and/or, for example, the driver pushes an accelerator pedal 'flat to the floor' (or otherwise to the limit of its travel), the noise modification system may during that period of acceleration act to enhance the engine noise. Upon cessation of the acceleration, the noise modification returns to 'off' or 'suppress' as nominally associated with the 'normal' vehicle mode.

In a scenario, if the vehicle is being driven in a manner such that rapid accelerations, steering wheel inputs, and/or braking are frequent, or any other indications are present that enthusiastic driving is being undertaken, the enhancement action of the noise modification system may be enabled. Should such driving then cease, or have ceased for a certain period of time (such as may be consistent with having come off a smaller, winding road and having then entered a motorway or expressway or similar and then maintaining a steady straight-line (or nearly straight-line) speed, the noise modification system may be deactivated, or may even begin a noise suppression action so as to provide a more relaxing and comfortable experience for the driver.

In an alternative scenario, where a driver performs the action of accelerating sharply (on transition from a 30 mph to a 70 mph zone, for example), a 'normal' or even 'hush' (or 'quiet' or 'stealth') vehicle mode may be selected, and the noise modification system will remain inactive—or alternatively, may act to suppress noise in the 30 mph zone but then simply be turned off during the period of acceleration—allowing for more noise but not actively enhancing it.

It can thus be seen that the activity of the noise modification system is to at least some degree, or even totally, independent of the selected drive mode of the vehicle, although it may be influenced by the selected drive mode.

The action of the noise modification system is in neither case fully determined by the selected vehicle drive mode and may even exhibit the full possible range of active/partially active/inactive states in various driving conditions whilst the vehicle remains in a single selected vehicle drive mode, the relative activity state depending on the momentary or on a time-based analysis of driving style or driver behaviour, ie: a driving style determination.

In embodiments, the driving style determination may be made based on a momentary driving style or may be made based on a determination of driving style over a period of time.

A momentary driving style may be determined by, for example, use of a throttle/accelerator pedal. For example, a maximum accelerator pedal depression or displacement (driver's foot pushing a pedal all the way down), may be taken as evidence of 'sporty' driving, at which an enhanced engine/exhaust noise may be appropriate. Alternatively, a rate at which the pedal is pressed may be the determinant—if the pedal is pressed down quickly (say at least half of the pedal travel traversed in less than a second), a noise enhancement action may be activated where previously the noise modification system was 'off'; but if the pedal is pressed down slowly (half travel in a second or more), no activation of the enhancement action of the sound modification system may occur. It may be that if throttle use is particularly slow (half travel in more than 3 seconds, for example), then the noise modification system may in fact then be activated so as to suppress or cancel engine/exhaust noise.

Other determinants of momentary driving style may be similarly or equivalently applied, and may comprise:

i/ a throttle position or rate of change of throttle position
ii/ an engine speed
iii/ a rate of change of engine speed
iv/ a steering angle
v/ a rate of change of steering angle
vi/ a gear change or selection
vii/ a rate of gear change or selection
viii/ a vehicle speed
ix/ a rate of change of vehicle speed
x/ a brake pedal position
xi/ a brake application
xii/ a rate of brake application
xiii/ an engine load
xiv/ a rate of change of engine load Comparatively fast steering inputs, gear changes, speeds, brake applications, or rates of change of same, or other actions that indicate sporty, enthusiastic or spirited driving, may trigger a noise enhancement action of the noise modification system, whereas slower or absent such indicators may not trigger an enhancement or may trigger noise suppression/cancellation.

In some vehicles, there are provided systems for control of, for example, a transmission system of the vehicle. Such a system, in using a particular transmission 'shift map', may make its own determination of driver behaviour/driving style in order to determine which of a plurality of shift maps to use. In embodiments of the invention, therefore, a determinant of driving style may comprise xv/ a determination of driving style by a further system of the vehicle, optionally a transmission control system.

A determination of driving style over a period of time may take the form of, for example, an analysis of throttle pedal behaviour over a period of time. If there have been a number of changes of throttle pedal state, say 5 separate incidences of throttle pedal depression and subsequent throttle pedal release, within a one-minute period of time, then this may be taken to be indicative of enthusiastic driving.

Other determinants of driving style over a period of time may include:

i/ a number of changes of a driver control input over the period of time ii/ the period of time since a driver control input iii/ a number of changes of any two or more driver control inputs over the period of time iv/ variance in vehicle speed over the period of time v/ changes in vehicle direction over the period of time.

The driver control inputs that may be taken into consideration may include:

i/ a throttle input; optionally its magnitude or rate of change ii/ a steering input; optionally its magnitude or rate of change iii/ a gear change or selection iv/ a braking input; optionally its magnitude or rate of change It may be that if the vehicle is in a 'normal', 'sport', 'dynamic' or, especially, a 'track' driving mode, the noise modification system is then nominally arranged to enhance the engine/exhaust noise during enthusiastic driving. If the vehicle is in a 'hush/quiet/stealth' mode, in which mode the noise modification system may nominally be set to noise suppression or cancel, such enthusiastic driving may, at least during the period of enthusiastic driving, turn the noise modification system off.

In this way it can be seen that in embodiments the noise modification system is responsive to a driving style of the driver at any given moment or over a period of time, whilst the vehicle is in any particular vehicle driving mode—and yet, the responsiveness of the noise modification system to driving style does not totally override the characteristics that might be expected of the vehicle when it is in a particular vehicle driving mode.

So, for example, a vehicle may be provided with three driving modes—'normal', 'sport' and 'dynamic', and the noise modification system may be able to modify the noise in one of three ways—noise suppression, 'off', or 'enhance'. In the 'normal' vehicle driving mode, the noise modification system may only ever switch between the noise suppression action/state and the 'off' state; whilst in the 'sport' mode, all three states (suppress, off, and enhance) may be used; and finally, whilst in the 'dynamic' mode, the noise modification system may be in 'enhance' state nearly all the time and just occasionally 'off'. The action of the noise modification system whilst in the various modes is determined as previously described herein. In this particular example, noise suppression may be provided by an Active Noise system and noise enhancement may be provided by an Active Exhaust, both sub-types of noise modification being present on the vehicle. Such an embodiment is shown in FIG. 1.

FIG. 2 gives a simple illustrative example of how a noise modification system may be set up to respond to one particular driver input—in this case, Throttle Pedal Movement, whilst the vehicle is in various Vehicle Driving Modes. The table indicates the activity state or modification action of the noise modification system in various combinations.

It will be recognised by one skilled in the art that this is merely a representative rather than a prescriptive model, and that other Throttle states may be considered as well as other Vehicle driving modes. The set response of the noise modification system may also vary with each combination depending on the desired characteristics of the vehicle.

It will also be appreciated that there will be an interaction of various driver inputs; for example the response of the noise modification system to throttle pedal movement may also vary according to the accompanying planned response of the noise modification system to brake pedal movement or steering wheel movement. It will be appreciated that this may require the use of a larger table or map, quite possibly multidimensional, in order to represent the modification activity of the noise modification system at any particular time in response to a multiplicity of such possible combinations of inputs. Such a map may be held in electronic format within the controller or elsewhere in the vehicle, in a computing or other electronic device or within some format of electronic memory. It may be that the noise modification system response map is amenable to change by a user of the vehicle, either via a Human Machine Interface (HMI) of the vehicle or by connection of the vehicle or a vehicle system to an external unit, such as a laptop, tablet, or similar electronic device. A vehicle user may then be able to 'download' any one of a series of pre-set noise modification system response maps into the vehicle or a system of the vehicle and thus change its response any number of times during the lifetime of the vehicle.

It will be recognised that the setting up of such noise modification system response maps may vary depending on vehicle type and the desired characteristics envisaged during vehicle development.

According to some, but not necessarily all examples there is provided a controller arranged to control a noise modification system of a vehicle provided with an exhaust system, wherein the controller is adapted to select a noise modification action of the noise modification system in dependence upon a driving style of a driver of the vehicle.

According to some, but not necessarily all examples there is provided a controller arranged to control a noise modification system of a vehicle provided with an exhaust system, the controller arranged to select a noise modification action of the noise modification system in dependence upon a selected driving mode of the vehicle, wherein the controller is further arranged to select an alternative noise modification action of the noise modification system in dependence upon a driving style of a driver of the vehicle. The alternative noise modification action may be selected whilst the driving mode of the vehicle remains unchanged.

According to some, but not necessarily all examples there is provided a method of control of a noise modification system adapted for use with an exhaust system of a vehicle, comprising the steps:

Determining a driving style of a driver of said vehicle, and;

Selecting a noise modification action of the noise modification system in dependence on the said driving style.

According to some, but not necessarily all examples there is provided a method of control of a noise modification system adapted for use with an exhaust system of a vehicle, comprising the steps:

Selecting a vehicle Driving Mode;

Determining a driving style of a driver of the vehicle, and;

Selecting a noise modification action of the noise modification system in dependence on the said driving style.

According to some, but not necessarily all examples there is provided a method of control of a noise modification system adapted for use with an exhaust system of a vehicle, comprising the steps;

Selecting a vehicle Driving Mode;

Selecting a noise modification action of the noise modification system associated with said Driving Mode;

Determining a driving style of a driver of the vehicle, and;

Changing the noise modification action of the noise modification system in dependence on the said driving style.

For purposes of this disclosure, it is to be understood that the controller described herein can comprise a control unit or computational device having one or more electronic processors.

A vehicle and/or a system thereof may comprise a single control unit or electronic controller or alternatively different functions of the controller may be embodied in, or hosted in, different control units or controllers.

As used herein, the term "control unit" will be understood to include both a single control unit or controller and a plurality of control units or controllers collectively operating to provide the required control functionality.

A set of instructions could be provided which, when executed, cause said controller(s) or control unit(s) to implement the control techniques described herein (including the method(s) described below). The set of instructions may be embedded in one or more electronic processors, or alternatively, the set of instructions could be provided as software to be executed by one or more electronic processor(s). For example, a first controller may be implemented in software run on one or more electronic processors, and one or more other controllers may also be implemented in software run on or more electronic processors, optionally the same one or more processors as the first controller. It will be appreciated, however, that other arrangements are also useful, and therefore, the present invention is not intended to be limited to any particular arrangement. In any event, the set of instructions described above may be embedded in a computer-readable storage medium (e.g., a non-transitory storage medium) that may comprise any mechanism for storing information in a form readable by a machine or electronic processors/computational device, including, without limitation: a magnetic storage medium (e.g., floppy diskette); optical storage medium (e.g., CD-ROM); magneto optical storage medium; read only memory (ROM); random access memory (RAM); erasable programmable memory (e.g., EPROM ad EEPROM); flash memory; or electrical or other types of medium for storing such information/instructions.

Within the scope of this application it is expressly envisaged that the various aspects, embodiments, examples and alternatives set out in the preceding paragraphs, in the claims and/or in the following description and drawings, and in particular the individual features thereof, may be taken independently or in any combination. Features described in connection with one embodiment are applicable to all embodiments, unless such features are incompatible.

BRIEF DESCRIPTION OF THE DRAWINGS

One or more embodiments of the invention will now be described, by way of example only, with reference to the accompanying drawings, in which:

FIG. 2 shows a table indicating an activity mode of a noise modification system in response to a particular driver input, in this case Throttle Pedal Movement, whilst the vehicle is in various Vehicle Driving Modes.

DETAILED DESCRIPTION

Figure 1:
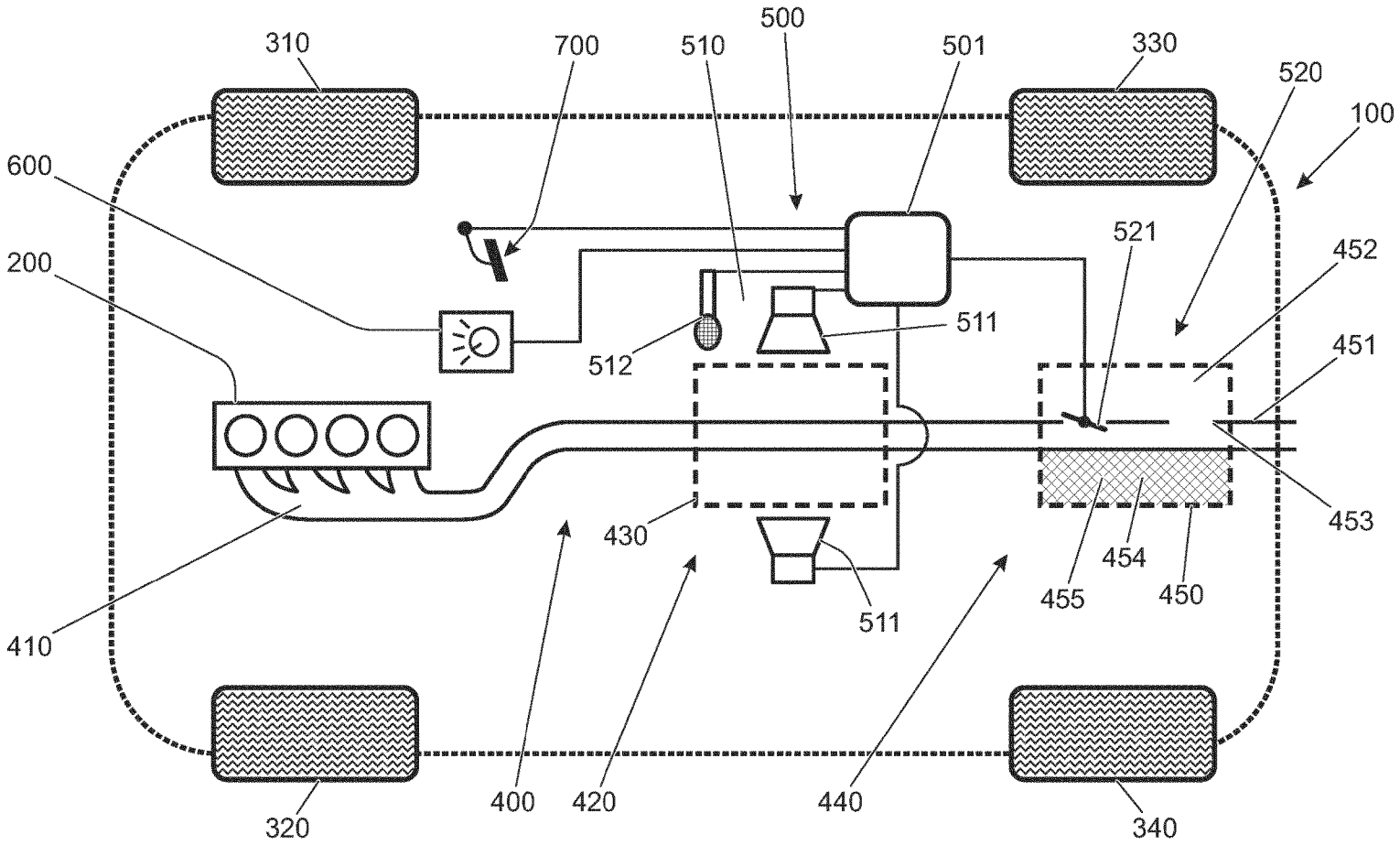
FIG. 1 shows a schematic representation of a vehicle provided with a noise modification system, comprising Active Noise and Active Exhaust systems, in accordance with embodiments of the invention, in combination with an exhaust system as may typically be found on a vehicle.
Figure 3:
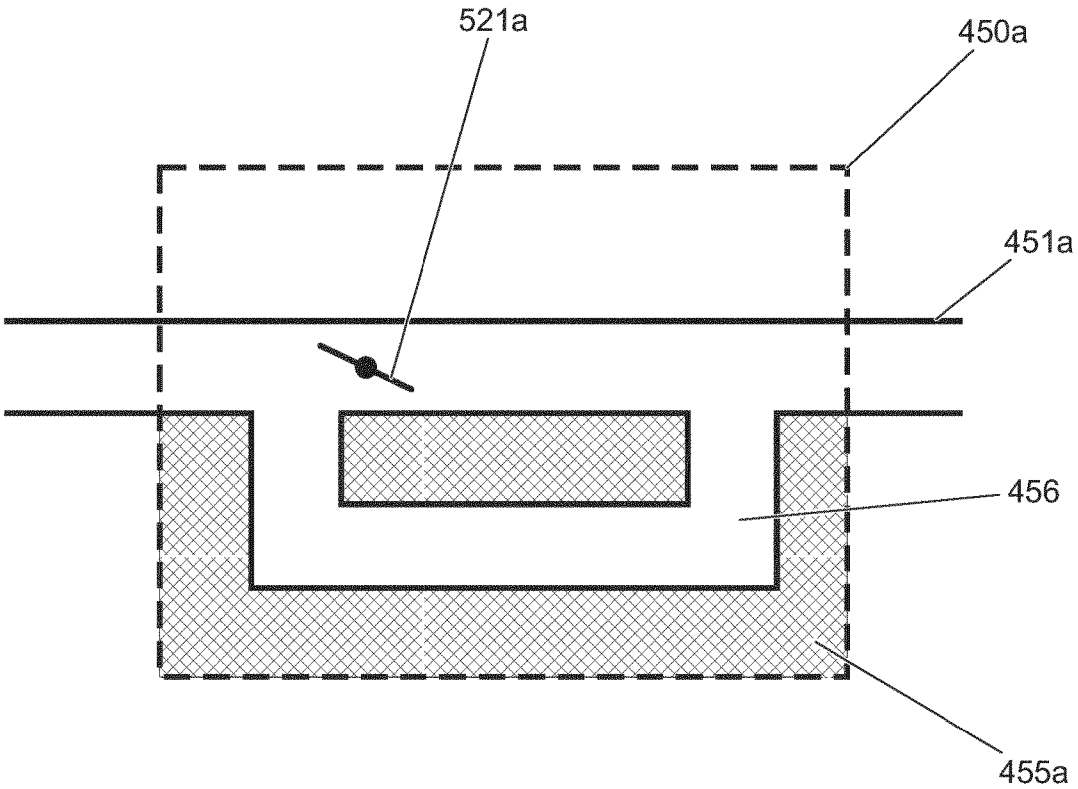
FIG. 3 shows a schematic representation of an alternative Active Exhaust system to that shown in FIG. 1.

An embodiment of the present invention is described herein with reference to the accompanying FIGS. 1, 2 and 3.

With reference to FIG. 1, there is a vehicle 100 which is provided with an engine 200, wheels 310, 320, 330, 340, an exhaust system 400 comprising manifolds 410, centre section 420 comprising muffler/box 430, and a rear section 440 comprising rear muffler/box 450. The exhaust system is provided with a noise modification system 500 which comprises both an Active Noise system 510 and an Active Exhaust system 520.

The Active Noise system 510 comprises control unit 501, speakers 511 and a noise sensor 512. Noise sensor 512 is arranged to 'pick up' engine/exhaust noise from centre section 420 and supply a noise signal to controller 501. The controller 501 is adapted to provide a control signal to speakers 511. In one modification action, controller 501 inverts the noise signal from sensor 512 and controls speakers 511 such that they provide a noise cancellation effect which reduces the overall engine/exhaust noise emitted by the exhaust system 400. This is the 'Suppression' noise modification action as referenced in FIG. 2. In an alternative modification action, controller 501 provides an amplification to the noise signal from sensor 512 and controls speakers 511 such that they add to/increase the overall engine/exhaust noise emitted by the exhaust system 400. This is the 'Enhance 1' noise modification action as further referenced in FIG. 2. In a third modification action, the speakers are not active—this is noted as 'Off' in reference to FIG. 2.

The Active Exhaust system 520 comprises control unit 501, exhaust box 450, and valve 521. Control unit 501 is adapted to control the valve 521. The valve 521 is arranged such that when it is closed, exhaust gasses from the engine 200 run straight through exit pipe 451. When valve 521 is open, a proportion of the exhaust gases are able to enter echo box 452 and then exit through opening 453 back into the exit pipe 451. The remainder of exhaust box 450, as illustrated in section of exhaust box 454, is provided with noise deadening material 455. When there are gasses passing through echo box 452, exhaust box 450 produces a louder sound and with different characteristics than when gasses are passing through exit pipe 451 alone, and so opening the valve 521 acts to enhance exhaust noise. This is the 'Enhance 2' noise modification action of the noise modification system 500 as further referenced in FIG. 2.

Accordingly, the noise modification system 500 of the vehicle 100 is able to perform four different noise modifi cation actions—namely, Suppress, Off, Enhance 1 and Enhance 2, by the various actions of the Active Noise 510 and Active Exhaust 520 sub-systems of the noise modification system 500.

machines may also be affected by a noise management system, in particular by an Active Noise system.

Referring now to FIG. 2, which comprises the Table below:

| | | Hush | Normal | Sport | Track |
|---|---|---|---|---|---|
| Throttle | Rapid | Off | Enhance 1 | Enhance 2 | Enhance 2 |
| | Slow | Suppress | Off | Enhance 1 | Enhance 2 |
| Pedal | Static instant (upper part of pedal travel) | Suppress | Off | Off | Enhance 1 |
| | Static instant (lower half of pedal travel) | Off | Off | Enhance 1 | Enhance 2 |
| Movement | Static >30 seconds | Suppress | Suppress | Off | Enhance 1 |
| | Static >60 seconds | Suppress | Suppress | Suppress | Off |

The skilled person will realise that this embodiment is just by way of example, and that alternative arrangements of Active Noise and/or Active Exhaust systems are possible and may be used whilst still remaining within the ambit of the invention. Further Active Noise sensors and speakers may be provided at other points within a vehicle, such as in an occupant cabin, for example, as well as at other points on an exhaust system. The overall noise of the engine/exhaust system may be controlled specifically via multiple speakers or sets of speakers so as to provide differing noise levels and sensations to those within a vehicle as compared to those outside of the vehicle. Differing noise levels/sensations may even be provided to multiple occupants of the occupant cabin of a vehicle, for example, a driver of the vehicle may be provided with differing sensations to those of passengers. An Active Exhaust system may include an arrangement comprising an exhaust box 450*a* such as the alternative noted in FIG. 3, wherein when valve 521*a* is closed, exhaust gases pass through exhaust pipe 456 which is surrounded by noise deadening material 455*a*, but when valve 521*a* is open, all or most of the exhaust gasses pass via 'straight through' exit pipe 451*a*, which thus provides a concomitantly louder exhaust noise. The skilled person will recognise that the FIG. 3 arrangement may provide a further advantage in that when acting as a 'straight through' pipe, the exhaust box 450*a* is likely to provide lesser exhaust backpressure and thus potentially allow the engine to generate more power—this may be particularly advantageous when in a 'Track' or similar mode, when rules, laws or regulations on noise may be less stringent than in a public road environment.

The vehicle 100 is further provided with a driving mode selector 600, which is operable by a driver to select one of four driving modes. Various characteristics of the vehicle are altered by the selection of the various driving modes, affecting such things as transmission shift maps and suspension response. However, associated with each of these modes is also an expectation of the noise that the vehicle is going to make whilst in that mode. Accordingly, there are four modes available, 'Track', where the vehicle is set up for racing; 'Sport', where the vehicle is set up for enthusiastic driving on public roads; 'Normal', where the vehicle is set up for normal, everyday driving, and 'Hush', where the vehicle is specifically set up to be as quiet as possible, for example for late-night driving in residential areas. This latter setting may be particularly apposite for use with Hybrid vehicles, and it will be recognised that elements of the invention are equally applicable to a hybrid-electric (HEV) or even electric (EV) vehicle, where noise from electric In the present embodiment, it can be seen that in 'Hush' mode, the noise modification system is largely set to either suppress noise (by use of the Active Noise sub-system) or to be 'Off'.

In 'Normal' mode, the noise modification system is largely inactive. One departure is when the throttle pedal (700) is moved rapidly, whereupon the Active Noise system is set to enhance the engine/exhaust noise, and thus 'Enhance 1' appears on the table. Another departure is when the pedal has been static for 30 seconds or more, possibly indicating steady-state driving, when the noise modification system is set to 'Suppress' by activation of the Active Noise system, to provide a comfortable driving experience for an extended period. In 'Sport' mode, it can be seen that the default action of the noise modification system is for the Active Noise system to provide enhancement, and so 'Enhance 1' appears in the table twice. However, if the accelerator pedal is static and in the upper part of pedal travel, or if the pedal is static for over 30 seconds, it is assumed that the driver is at least momentarily not driving enthusiastically or at speed, and so the Active Noise sub-system is turned off and so the noise modification action is set to 'Off'. If there is rapid accelerator/throttle pedal movement, however, the bypass valve 521 is opened and the 'Enhance 2' noise modification action is active, wherein both noise modification systems, Active Noise and Active Exhaust, are enhancing the noise. If the driver makes no change in input to the throttle (ie it is static) for more than 60 seconds, however, steady-state driving is assumed and as for 'Normal' mode, the Active Noise sub-system of the noise modification system is activated, thus providing a noise modification action of 'Suppress'.

Finally, in 'Track' mode, the noise modification system is nominally acting to use both the Active Noise and Active Exhaust systems to enhance the engine noise, and so 'Enhance 2' is the default. If the pedal is instantly static or static for over 30 seconds, 'Enhance 1' is active, and it is only in the situation where the pedal is static for over 60 seconds that the noise modification system is in the 'Off' arrangement. It can be seen that in 'Track' mode, the noise modification system is never in the 'Suppress' configuration.

It will be appreciated that various changes and modifications can be made to the present invention without departing from the scope of the present application. Further aspects of the present invention will now be set out in the accompanying numbered paragraphs:

1. A controller arranged to control a noise modification system of a vehicle provided with an exhaust system, wherein the controller is adapted to select a noise modification action of the noise modification system in dependence upon determination of a driving style of a driver of the vehicle.

2. A controller arranged to control a noise modification system of a vehicle provided with an exhaust system, the controller arranged to select a noise modification action of the noise modification system in dependence upon a selected driving mode of the vehicle, wherein the controller is further arranged to select an alternative noise modification action of the noise modification system in dependence upon determination of a driving style of a driver of the vehicle.

3. A controller as described in paragraph 2 wherein the alternative noise modification action is selected whilst the driving mode of the vehicle remains unchanged.

4. A controller as described in either of paragraphs 1 or 2 wherein the noise modification action comprises, non-exclusively, one of:
1/ a noise enhancement action;
2/ a noise suppression action;
3/ a noise cancelling action;
4/ no modification action.

5. A controller as described in paragraph 1 or 2 wherein the determination of driving style is made based on a determination of momentary driving style.

6. A controller as described in paragraph 1 or 2 wherein the determination of driving style is made based on a determination of driving style over a period of time.

7. A controller as described in paragraph 1 or 2 wherein the determination of driving style is made based on a combination of a determination of momentary driving style and a determination of driving style over a period of time.

8. A controller as described in paragraph 5 or 7 wherein the determination of momentary driving style is based on any one or more of the following;
i/ a throttle position or rate of change of throttle position
ii/ an engine speed
iii/ a rate of change of engine speed
iv/ a steering angle
v/ a rate of change of steering angle
vi/ a gear change or selection
vii/ a rate of gear change or selection
viii/ a vehicle speed
ix/ a rate of change of vehicle speed
x/ a brake pedal position
xi/ a brake application
xii/ a rate of brake application
xiii/ an engine load
xiv/ a rate of change of engine load
xv/ a determination of driving style by a further system of the vehicle, optionally a transmission control system.

9. A controller as described in paragraph 6 or 7 wherein the determination of driving style over a period of time is based on any one or more of the following:
i/ a number of changes of a driver control input over the period of time
ii/ the period of time since a driver control input
iii/ a number of changes of any two or more driver control inputs over the period of time
iv/ variance in vehicle speed over the period of time
v/ variance in vehicle direction over the period of time 10. A controller as described in paragraph 9 wherein a driver control input is any one or more of the following:
i/ a throttle input
ii/ a steering input
iii/ a rate of change of steering input
iv/ a gear change or selection
v/ a braking input
iv/ a rate of braking input 11. A controller as described in paragraph 1 or 2 wherein the noise modification system comprises one or more of an Active Noise system and an Active Exhaust system.

12. A method of control of a noise modification system adapted for use with an exhaust system of a vehicle, comprising the steps;
Selecting a vehicle Driving Mode;
Selecting a noise modification action of the noise modification system associated with said Driving Mode;
Determining a driving style of a driver of the vehicle, and;
Changing the noise modification action of the noise modification system in dependence on the said driving style.

13. A method as described in paragraph 12 claimed in any of claims 12 to 14 wherein the noise modification action comprises, non-exclusively, one of the following:
1/ a noise enhancement action;
2/ a noise suppression action;
3/ a noise cancelling action;
4/ no modification action.

14. A method as described in paragraph 12 wherein the determination of driving style is made based on a determination of momentary driving style.

15. A method as described in paragraph 12 wherein the determination of driving style is made based on a determination of driving style over a period of time.

16. A method as described in paragraph 12 wherein the determination of driving style is made based on a combination of a determination of momentary driving style and a determination of driving style over a period of time.

17. A method as described in paragraph 14 or 16 wherein the determination of momentary driving style is based on any one or more of the following;
i/ a throttle position or rate of change of throttle position
ii/ an engine speed
iii/ a rate of change of engine speed
iv/ a steering angle
v/ a rate of change of steering angle
vi/ a gear change or selection
vii/ a rate of gear change or selection
viii/ a vehicle speed
ix/ a rate of change of vehicle speed
x/ a brake pedal position
xi/ a brake application
xii/ a rate of brake application
xiii/ an engine load
xiv/ a rate of change of engine load
xv/ a determination of driving style by a further system of the vehicle, optionally a transmission control system.

18. A method as described in paragraph 15 or 16 wherein the determination of driving style over a period of time is based on any one or more of the following:
i/ a number of changes of a driver control input over the period of time
ii/ the period of time since a driver control input
iii/ a number of changes of any two or more driver control inputs over the period of time
iv/ variance in vehicle speed over the period of time
v/ variance in vehicle direction over the period of time 19. A method as described in paragraph 18 wherein a driver control input is any one or more of the following:
i/ a throttle input
ii/ a steering input
iii/ a rate of change of steering input
iv/ a gear change or selection v/ a braking input vi/ a rate of braking input 20. A method as described in paragraph 12 wherein the noise modification system comprises one or more of an Active Noise system and an Active Exhaust system.

21. A controller adapted to perform the method described in paragraph 12.

22. A noise modification system provided with a controller as described in paragraph 1 or 2 or as described in paragraph 21.

23. An exhaust system provided with a noise modification system as described in paragraph 22 or a controller as described in paragraph 21.

24. A vehicle provided with a controller as described in paragraph 21, a noise modification system as described in paragraph 22, or an exhaust system as described in paragraph 23.

The invention claimed is:

1. A controller comprising at least one electronic processor and at least one computer-readable storage medium including a set of instructions, the at least one computer-readable storage medium and the set of instructions configured to, with the at least one electronic processor, cause the controller at least to control a noise modification system of a vehicle provided with an exhaust system, by:

selecting a noise modification action of the noise modification system in dependence upon a selected driving mode of the vehicle;

selecting an alternative noise modification action of the noise modification system in dependence upon a driving style of a driver of the vehicle, wherein when the selected driving mode is a first driving mode the alternative noise modification action is selected from a first set of a plurality of noise modification actions in dependence on the driving style, wherein when the selected driving mode is a second driving mode the alternative noise modification action is selected from a second set of a plurality of noise modification actions in dependence on the driving style, and wherein the first set of noise modification actions comprises at least one noise modification action that is not in the second set of noise modification actions; and transmitting a control signal to cause one or more speakers to modify noise in the exhaust system in dependence on said noise modification action.

2. A controller as claimed in claim 1, wherein the at least one computer-readable storage medium and the set of instructions are configured to, with the at least one electronic processor, cause the controller to receive a noise signal from a noise sensor providing a measurement of noise in the exhaust system, wherein the noise modification action is dependent on said measurement of noise.

3. A controller as claimed in claim 2, wherein the at least one computer-readable storage medium and the set of instructions are configured to, with the at least one electronic processor, cause the controller to transmit the control signal to cause said one or more speakers to modify said measured noise in the exhaust system.

4. A controller as claimed in claim 2, wherein the noise signal from the noise sensor provides a measurement of noise in the exhaust system modified by said noise modification action.

5. A controller as claimed in claim 1 wherein the alternative noise modification action is selected while the driving mode of the vehicle remains unchanged.

6. A controller as claimed in claim 1, wherein the noise modification action comprises at least one of:

a noise enhancement action;

a noise suppression action; and a noise cancelling action.

7. A controller as claimed in claim 1, wherein the driving style is based on a momentary driving style.

8. A controller as claimed in claim 7, wherein the momentary driving style is based on any one or more of the following;

i/ a throttle position or rate of change of throttle position, ii/ an engine speed, iii/ a rate of change of engine speed, iv/ a steering angle, v/ a rate of change of steering angle, vi/ a gear change or selection, vii/ a rate of gear change or selection, viii/ a vehicle speed, ix/ a rate of change of vehicle speed, x/ a brake pedal position, xi/ a brake application, xii/ a rate of brake application, xiii/ an engine load, xiv/ a rate of change of engine load, and xv/ a determination of driving style by a further system of the vehicle.

9. A controller as claimed in claim 1, wherein the driving style is based on a driving style over a period of time.

10. A controller as claimed in claim 9, wherein the driving style over a period of time is based on any one or more of the following:

i/ a number of changes of a driver control input over the period of time, ii/ the period of time since a driver control input, iii/ a number of changes of any two or more driver control inputs over the period of time, iv/ variance in vehicle speed over the period of time, and v/ variance in vehicle direction over the period of time.

11. A controller as claimed in claim 10 wherein a driver control input is any one or more of the following:

i/ a throttle input, ii/ a steering input, iii/ a rate of change of steering input, iv/ a gear change or selection, v/ a braking input, and vi/ a rate of braking input.

12. A controller as claimed in claim 1, wherein the driving style is based on a combination of a momentary driving style and a driving style over a period of time.

13. A controller as claimed in claim 1, wherein the noise modification system comprises an Active Noise system or an Active Noise System and an Active Exhaust system, wherein the Active Noise System comprises the one or more speakers configured to be fitted to the exhaust system to modify the noise in the exhaust system, and wherein the Active Exhaust System comprises one or more bypass valves configured to be within the exhaust system, the one or more bypass valves being controllable to alter a flow path of exhaust gases through different parts of the exhaust system to modify the noise in the exhaust system.

14. A controller as claimed in claim 1, wherein the one or more speakers are configured to be fitted to the exhaust system upstream of a rear muffler of the exhaust system, to modify noise in the exhaust system.

15. A controller as claimed in claim 1, wherein the driving style is dependent on a rate of change of one or more inputs to one or more driver controls.

16. A controller as claimed in claim 1, wherein the second set of noise modifications comprises a noise suppression action and the at least one noise modification action that is not in the second set of noise modification actions is a noise enhancement action, or the second set of noise modification actions comprises a noise enhancement action and the at least one noise modification action that is not in the second set of noise modification actions is a noise suppression action.

17. A controller as claimed in claim 1, wherein the first set of noise modification actions comprises more than two noise modification actions, the second set of noise modification actions comprises more than two noise modification actions, or a combination thereof.

18. A noise modification system provided with a controller as claimed in claim 1.

19. A noise modification system as claimed in claim 18, comprising one or more speakers, and a noise sensor configured to pick up noise generated by the exhaust system and transmit a noise signal to the controller, wherein the controller is arranged to transmit a control signal to cause said one or more speakers to modify exhaust noise in dependence on the noise signal.

20. An exhaust system provided with the noise modification system of claim 18.

21. An exhaust system as claimed in claim 20, wherein a noise sensor and one or more speakers are acoustically connected to said exhaust system.

22. An exhaust system as claimed in claim 21, comprising a center section, wherein the noise sensor and the one or more speakers are acoustically connected to said center section.

23. A vehicle provided with the exhaust system of claim 20.

24. A method of control of a noise modification system adapted for use with an exhaust system of a vehicle, comprising:

selecting a vehicle driving mode;

selecting a noise modification action of the noise modification system associated with said driving mode;

determining a driving style of a driver of the vehicle;

changing the noise modification action of the noise modification system in dependence on the driving style, wherein when the selected driving mode is a first driving mode the changed noise modification action is selected from a first set of a plurality of noise modification actions in dependence on the driving style, wherein when the selected driving mode is a second driving mode the changed noise modification action is selected from a second set of a plurality of noise modification actions in dependence on the driving style, and wherein the first set of noise modification actions comprises at least one noise modification action that is not in the second set of noise modification actions; and causing, at least in part, modification of noise in the exhaust system in dependence on said noise modification action.

25. A method as claimed in claim 24, wherein the noise modification action comprises at least one of the following:

a noise enhancement action;

a noise suppression action; and a noise cancelling action.

26. A method as claimed in claim 24, wherein the driving style is based on a momentary driving style.

27. A method as claimed in claim 26, wherein the momentary driving style is based on any one or more of the following:

i/ a throttle position or rate of change of throttle position, ii/ an engine speed, iii/ a rate of change of engine speed, iv/ a steering angle, v/ a rate of change of steering angle, vi/ a gear change or selection, vii/ a rate of gear change or selection, viii/ a vehicle speed, ix/ a rate of change of vehicle speed, x/ a brake pedal position, xi/ a brake application, xii/ a rate of brake application, xiii/ an engine load, xiv/ a rate of change of engine load, and xv/ a determination of driving style by a further system of the vehicle.

28. A method as claimed in claim 24, wherein the driving style is based on a driving style over a period of time.

29. A method as claimed in claim 28, wherein the driving style over a period of time is based on any one or more of the following:

i/ a number of changes of a driver control input over the period of time, ii/ the period of time since a driver control input, iii/ a number of changes of any two or more driver control inputs over the period of time, iv/ variance in vehicle speed over the period of time, and v/ variance in vehicle direction over the period of time.

30. A method as claimed in claim 29, wherein the any two or more driver control inputs includes any two or more of the following:

i/ a throttle input, ii/ a steering input, iii/ a rate of change of steering input, iv/ a gear change or selection, v/ a braking input, and vi/ a rate of braking input.

31. A method as claimed in claim 24, wherein the driving style is based on a combination of a momentary driving style and a driving style over a period of time.

32. A method as claimed in claim 24, wherein the noise modification system comprises one or more of an Active Noise system and an Active Exhaust system, wherein the Active Noise System comprises one or more speakers configured to be fitted to the exhaust system to modify the noise in the exhaust system, and wherein the Active Exhaust System comprises one or more bypass valves configured to be within the exhaust system, the one or more bypass valves being controllable to alter a flow path of exhaust gases through different parts of the exhaust system to modify the noise in the exhaust system.

33. A method as claimed in claim 24, comprising receiving a noise signal providing a measurement of noise in the exhaust system modified by said noise modification action.

34. A method as claimed in claim 33, comprising causing, at least in part, further modification of said measured noise in the exhaust system in dependence on said noise signal.

* * * * *